US005692616A

United States Patent [19]

Baker

[11] Patent Number: 5,692,616

[45] Date of Patent: Dec. 2, 1997

[54] SANITARY DRINKING CUP LID

[76] Inventor: Dennis Baker, 771 W. Ironstone, Harrisville, R.I. 02830

[21] Appl. No.: 751,399

[22] Filed: Nov. 18, 1996

[51] Int. Cl.[6] ..... B65D 85/48

[52] U.S. Cl. ..... 206/449; 206/217; 220/713; 220/367.1

[58] Field of Search ..... 206/449, 484, 206/217; 220/711, 703, 257, 713, 714, 367.1

[56] References Cited

U.S. PATENT DOCUMENTS

| | | | |
|---|---|---|---|
| 3,204,805 | 9/1965 | May | 220/257 |
| 4,895,270 | 1/1990 | Main et al. | 220/257 |
| 5,072,849 | 12/1991 | Blau | 20/711 |

*Primary Examiner*—Paul T. Sewell

*Assistant Examiner*—Nhan T. Lam

[57] ABSTRACT

A new Sanitary Drinking Cup Lid for offering a drinking cup lid which is sanitarily singly packaged. The inventive device includes a drinking cup lid and a protective covering enclosing the drinking cup lid, wherein the protective covering is peeled from the drinking cup lid by the user prior to use. The drinking cup lid comprises a cover portion and a lip portion displaced peripherally around the cover portion. A drink opening is provided in the cover portion adjacent the lip portion. The protective covering enclosing the drinking cup lid comprises a top protective sheet and a bottom protective sheet. The top protective sheet and the bottom protective sheet are joined together beyond the periphery of the drinking cup lid as well as through the drink opening. The bottom protective sheet includes a perforation located concentrically within the underside of lip portion of the drinking cup lid such that when the drinking cup lid is press fit onto the cup rim, the perforation separates the bottom protective sheet into two sections.

4 Claims, 3 Drawing Sheets

SANITARY DRINKING CUP LID

BACKGROUND OF THE INVENTION

1. Field of the Invention

The present invention relates to cup lids and more particularly pertains to a new Sanitary Drinking Cup Lid for offering a drinking cup lid which is sanitarily singly packaged.

2. Description of the Prior Art

The use of cup lids is known in the prior art. More specifically, cup lids heretofore devised and utilized are known to consist basically of familiar, expected and obvious structural configurations, notwithstanding the myriad of designs encompassed by the crowded prior art which have been developed for the fulfillment of countless objectives and requirements.

Known prior art cup lids include U.S. Pat. No. 5,197,624; U.S. Pat. No. 5,090,584; U.S. Pat. No. D271,857; U.S. Pat. No. 5,111,961; U.S. Pat. No. 4,615,459 and U.S. Pat. No. 4,090,660.

While these devices fulfill their respective, particular objectives and requirements, the aforementioned patents do not disclose a new Sanitary Drinking Cup Lid. The inventive device includes a drinking cup lid and a protective covering enclosing the drinking cup lid, wherein the protective covering is peeled from the drinking cup lid by the user prior to use.

In these respects, the Sanitary Drinking Cup Lid according to the present invention substantially departs from the conventional concepts and designs of the prior art, and in so doing provides an apparatus primarily developed for the purpose of offering a drinking cup lid which is sanitarily singly packaged.

SUMMARY OF THE INVENTION

In view of the foregoing disadvantages inherent in the known types of cup lids now present in the prior art, the present invention provides a new Sanitary Drinking Cup Lid construction wherein the same can be utilized for offering a drinking cup lid which is sanitarily singly packaged.

The general purpose of the present invention, which will be described subsequently in greater detail, is to provide a new Sanitary Drinking Cup Lid apparatus and method which has many of the advantages of the cup lids mentioned heretofore and many novel features that result in a new Sanitary Drinking Cup Lid which is not anticipated, rendered obvious, suggested, or even implied by any of the prior art cup lids, either alone or in any combination thereof.

To attain this, the present invention generally comprises a drinking cup lid and a protective covering enclosing the drinking cup lid, wherein the protective covering is peeled from the drinking cup lid by the user prior to use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Sanitary Drinking Cup Lid apparatus and method which has many of the advantages of the cup lids mentioned heretofore and many novel features that result in a new Sanitary Drinking Cup Lid which is not anticipated, rendered obvious, suggested, or even implied by any of the prior art cup lids, either alone or in any combination thereof.

It is another object of the present invention to provide a new Sanitary Drinking Cup Lid which may be easily and efficiently manufactured and marketed.

It is a further object of the present invention to provide a new Sanitary Drinking Cup Lid which is of a durable and reliable construction.

An even further object of the present invention is to provide a new Sanitary Drinking Cup Lid which is susceptible of a low cost of manufacture with regard to both materials and labor, and which accordingly is then susceptible of low prices of sale to the consuming public, thereby making such Sanitary Drinking Cup Lid economically available to the buying public.

Still yet another object of the present invention is to provide a new Sanitary Drinking Cup Lid which provides in the apparatuses and methods of the prior art some of the advantages thereof, while simultaneously overcoming some of the disadvantages normally associated therewith.

Still another object of the present invention is to provide a new Sanitary Drinking Cup Lid for offering a drinking cup lid which is sanitarily singly packaged.

Yet another object of the present invention is to provide a new Sanitary Drinking Cup Lid which includes a drinking cup lid and a protective covering enclosing the drinking cup lid, wherein the protective covering is peeled from the drinking cup lid by the user prior to use.

Still yet another object of the present invention is to provide a new Sanitary Drinking Cup Lid that would provide a safe germ-free method of handling drinking cup lids.

Even still another object of the present invention is to provide a new Sanitary Drinking Cup Lid that would provide for storage of a drinking cup lid in a hygienic environment. In essence, protecting the drinking cup lid from exposure to germs, getting wet, and collecting dust.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
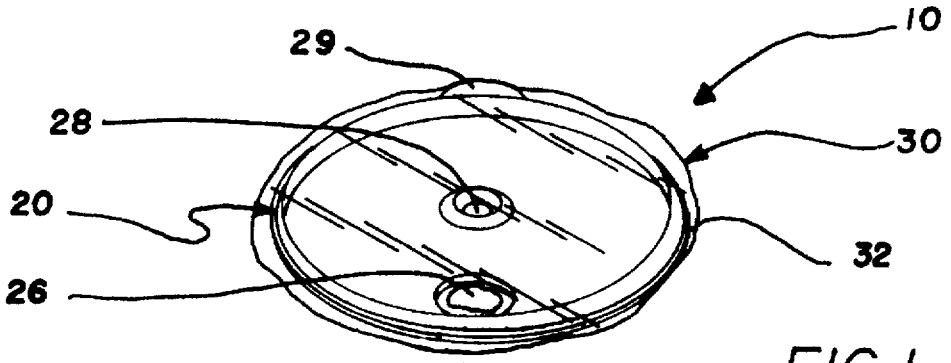
FIG. 1 is an illustration of a new Sanitary Drinking Cup Lid according to the present invention.
Figure 2:
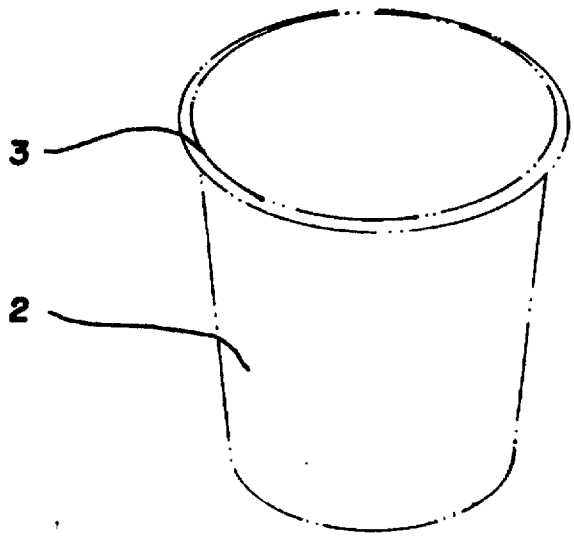
FIG. 2 is a top view of the present invention.
Figure 2:
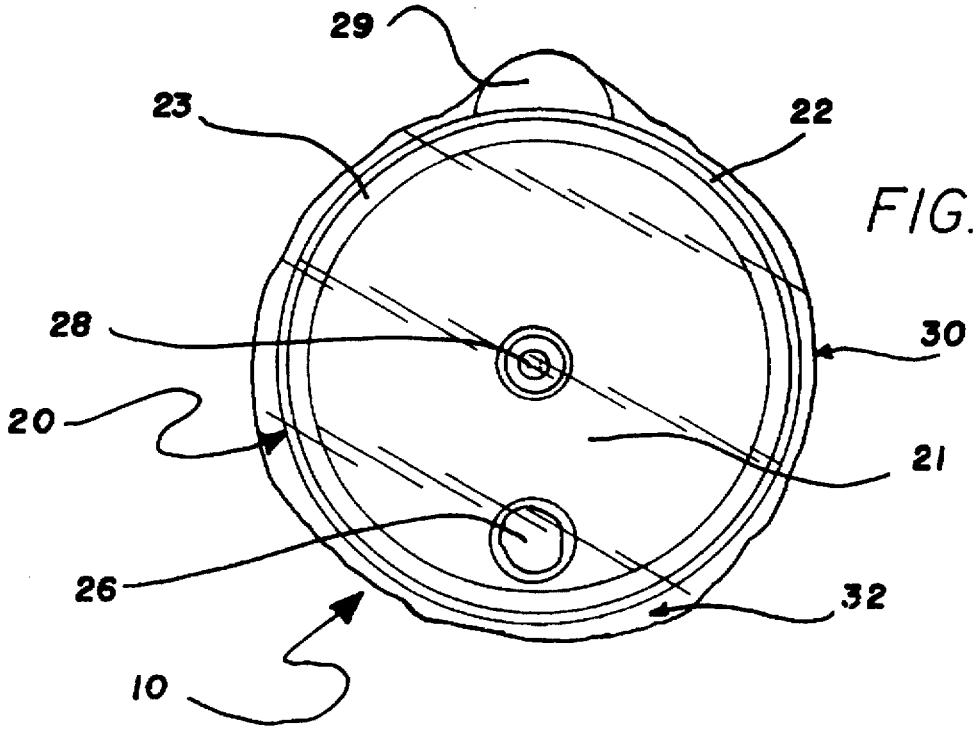
Figure 3:
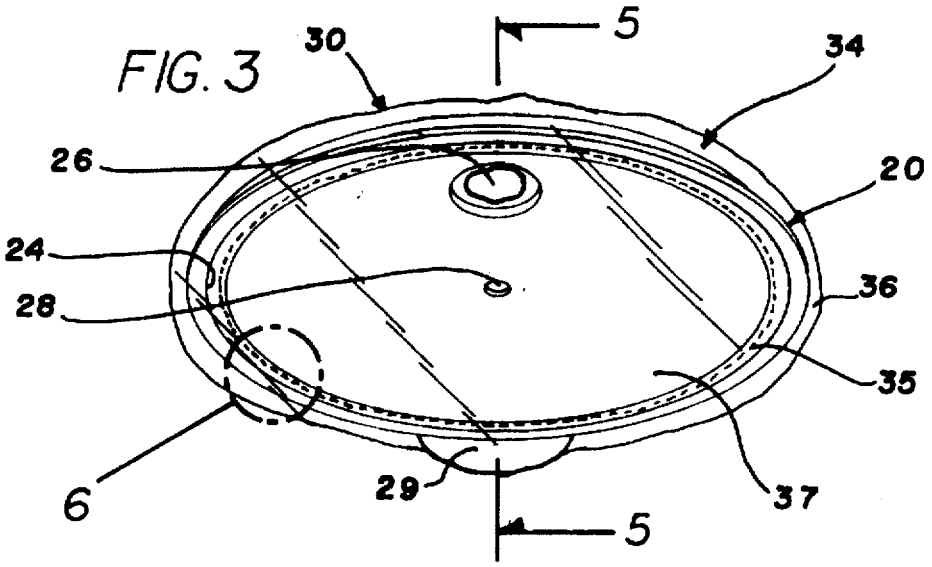
FIG. 3 is a bottom view of the present invention.

With reference now to the drawings, and in particular to FIGS. 1 through 6 thereof, a new Sanitary Drinking Cup Lid embodying the principles and concepts of the present invention and generally designated by the reference numeral 10 will be described.

More specifically, it will be noted that the Sanitary Drinking Cup Lid 10 comprises a drinking cup lid 20 and a protective covering 30 enclosing the drinking cup lid, wherein the protective covering 30 is peeled from the drinking cup lid 20 by the user prior to use. As best illustrated in FIG. 1, it can be shown that the present invention is intended for use with a drinking cup 2 having a cup rim 3.

Figure 5:
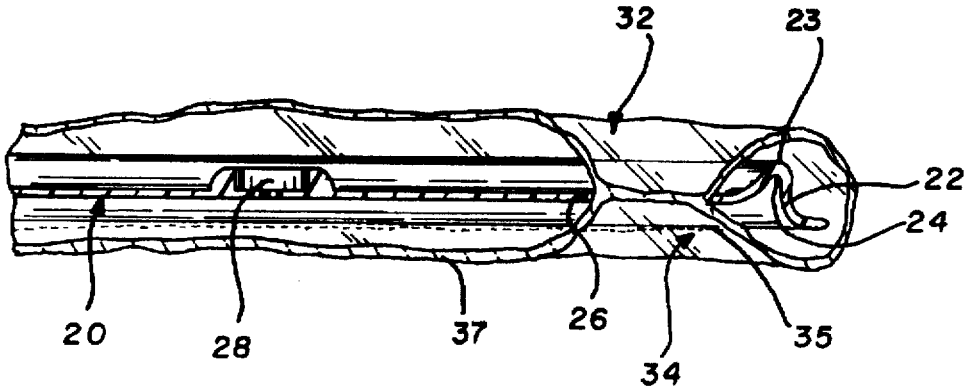
FIG. 5 is a cross sectional view taken along line 5—5 of FIG. 3.

The drinking cup lid 20 comprises a cover portion 21 and a lip portion 22 displaced peripherally around the cover portion 21. As best illustrated in FIG. 5, it can be shown that the lip portion 22 comprises an annular ridge 23 creating an inverted annular trough 24 thereunder. The inverted annular trough 24 is adapted to receive the cup rim 3 of the drinking cup 2 such that when the drinking cup lid 20 is press fit onto the cup rim 3, the cup rim 3 releasably engages the inverted annular trough 24. A drink opening 26 is provided in the cover portion 21 near the lip portion 22 to facilitate drinking of the contents of the drinking cup 2 through the drinking cup lid 20. In addition, a vent hole 28 is provided in the cover portion 21 to facilitate the flow of liquid from the drinking cup 2. A pull tab 29 extends beyond the periphery of the drinking cup lid 20 to facilitate removal of the drinking cup lid 20 from the cup rim 3 of the drinking cup 2.

Figure 6:
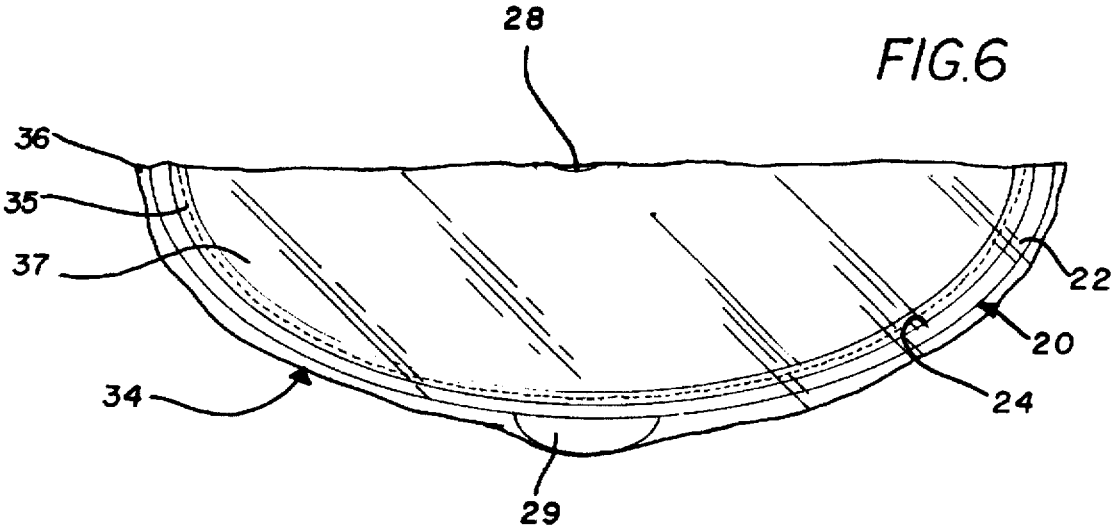
FIG. 6 is a detailed illustration of area 6 identified in FIG. 3.

The protective covering 30 enclosing the drinking cup lid 20 comprises a top protective sheet 32 and a bottom protective sheet 34. The top protective sheet 32 and the bottom protective sheet 34 are made of cellophane. The top protective sheet 32 and the bottom protective sheet 34 extend and are joined together beyond the periphery of the drinking cup lid 20. As best illustrated in FIG. 6, it can be shown that the bottom protective sheet 34 includes a perforation 35 located concentrically within the inverted annular trough 24 of the lip portion 22 of the drinking cup lid 20. The perforation 35 divides the bottom protective sheet 34 into an exterior section 36 and an interior section 34. The top protective sheet 32 and the exterior section 36 of the bottom protective sheet 34 extend and are joined together beyond the periphery of the drinking cup lid 20. As best illustrated in FIG. 5, it can be shown that the top protective sheet 32 and the interior section 37 of the bottom protective sheet 34 are joined together through the drink opening 26 of the drinking cup lid 20.

Figure 4:
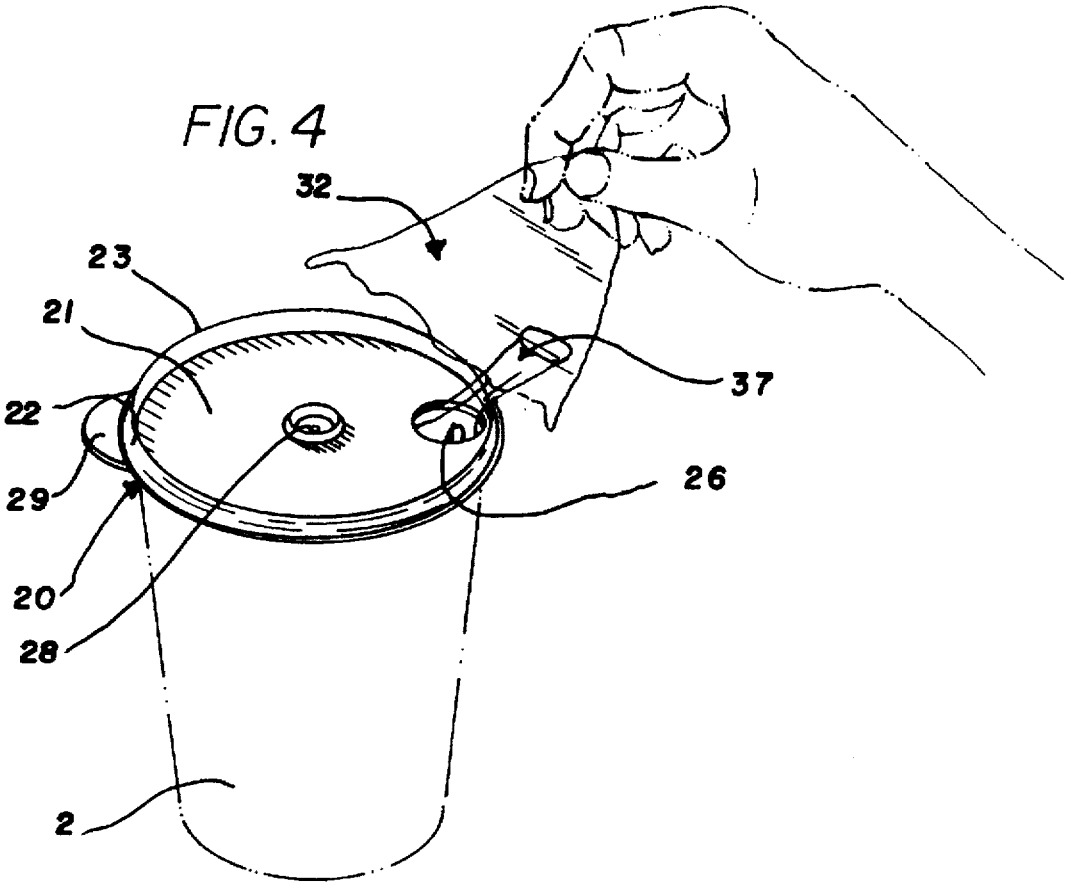
FIG. 4 is an illustration of the removal of the protective covering from the drinking cup lid according to the present invention.

In use, the drinking cup lid 20 is press fit onto the cup rim 3 of the drinking cup 2. When this is done, the cup rim 3 engages the perforation 35 of the bottom protective sheet 34 along the inverted annular trough 24 of the drinking cup lid 20 and distinctly separates the bottom protective sheet 34 into exterior section 36 and interior section 37. As best illustrated in FIG. 4, the protective covering 30 is peeled from the drinking cup lid 20 by grasping the portion of the top protective sheet 32 and the exterior section 36 of the bottom protective sheet 34 extending beyond the periphery of the drinking cup lid 20. Since the top protective sheet 32 and the interior section 37 of the bottom protective sheet 34 are joined together through the drink opening 26 of the drinking cup lid 20, the interior section 37 of the bottom protective sheet 34 is pulled through the drink opening 26. Once removed, the protective covering 30 may be discarded as a single piece.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Sanitary Drinking Cup Lid for use with a drinking cup having a cup rim comprising:

a drinking cup lid, said drinking cup lid comprising a cover portion and a lip portion displaced peripherally around said cover portion, said lip portion comprising an annular ridge creating an inverted annular trough thereunder, said inverted annular trough adapted to receive said cup rim of said drinking cup, said cover portion having a drink opening therein adjacent said lip portion; and a protective covering enclosing said drinking cup lid, wherein said protective covering is peeled from said drinking cup lid by a user prior to use, said protective covering comprising a top protective sheet and a bottom protective sheet, said top protective sheet and said bottom protective sheet extending and joined together beyond the periphery of said drinking cup lid, said bottom protective sheet including a perforation located concentrically within said inverted annular trough of said drinking cup lid, said perforation dividing said bottom protective sheet into an exterior section and an interior section, said top protective sheet and said exterior section of said bottom protective sheet extending and joined together beyond the periphery of said drinking cup lid, said top protective sheet and said interior section of said bottom protective sheet joined together through said drink opening of said drinking cup lid.

2. The Sanitary Drinking Cup Lid of claim 1, wherein said cover portion of said drinking cup lid has a vent hole therein.

3. The Sanitary Drinking Cup Lid of claim 1, wherein said drinking cup lid further comprises:

a pull tab extending beyond the periphery of said drinking cup lid.

4. The Sanitary Drinking Cup Lid of claim 1, wherein said top protective sheet and said bottom protective sheet are made of cellophane.

* * * * *